United States Patent [19]

Walter

[11] 4,197,960

[45] Apr. 15, 1980

[54] PILFERPROOF CONTAINER

[75] Inventor: John Walter, Evergreen Park, Ill.

[73] Assignee: The Continental Group, Inc., New York, N.Y.

[21] Appl. No.: 956,773

[22] Filed: Nov. 1, 1978

[51] Int. Cl.[2] ..... B65D 41/32; B65D 41/34

[52] U.S. Cl. ..... 220/266; 215/252; 215/253; 215/258; 222/153

[58] Field of Search ..... 215/256, 258, 252, 253; 220/265, 266, 288, 307; 222/153, 541

[56] References Cited

U.S. PATENT DOCUMENTS

| | | | |
|---|---|---|---|
| 3,463,341 | 8/1969 | Fields | 215/252 |
| 3,737,064 | 6/1973 | Patel et al. | 215/258 X |

*Primary Examiner*—George T. Hall

*Attorney, Agent, or Firm*—John J. Kowalik; Joseph E. Kerwin; Charles E. Brown

[57] ABSTRACT

A tamper-proof cap and neck assembly made of stretchable plastic material in which the neck has portions fitted within and about a short metal neck portion of a container which serves as a rigidifying back up for the plastic neck and for a locking shoulder on the neck to provide a deflection resistant structure and thereby prevent a tamper-indicating ring connected to the cap from slipping off the shoulder without tearing upon initial unthreading of the cap. This rigidified structure also facilitates application of the tamper-indicating ring during initial threading of the cap onto the threaded neck at which time the ring is stretched over the shoulder by a capper bead which engages force-transmitting posts integral with the ring for forcing the ring over the locking shoulder, the band being stretched between the posts and extending beneath the shoulder as chordal segments.

16 Claims, 9 Drawing Figures

FIG. 4
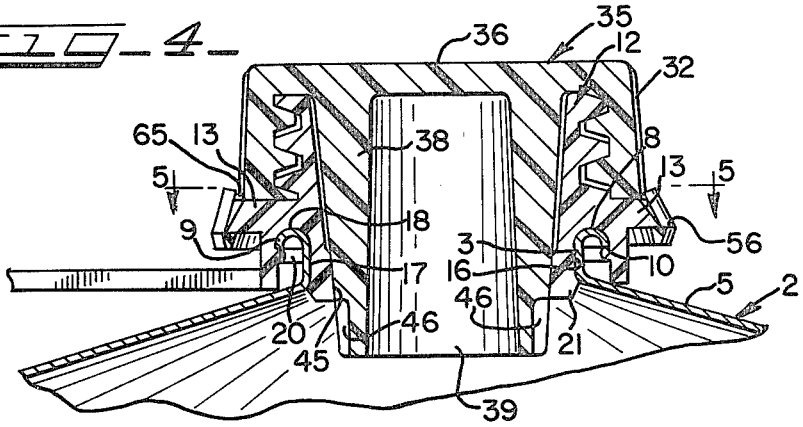
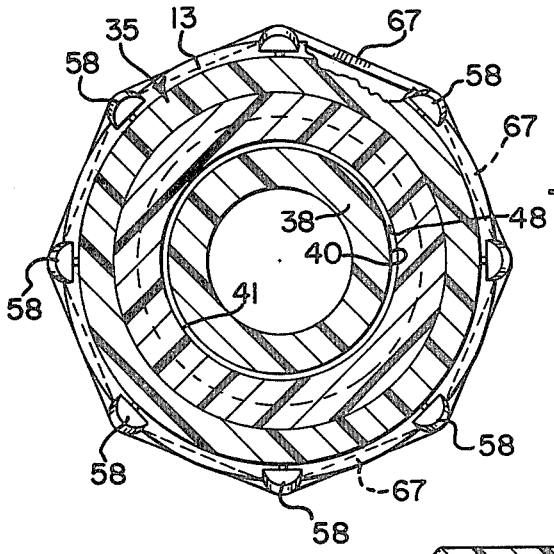
FIG. 5
FIG. 6
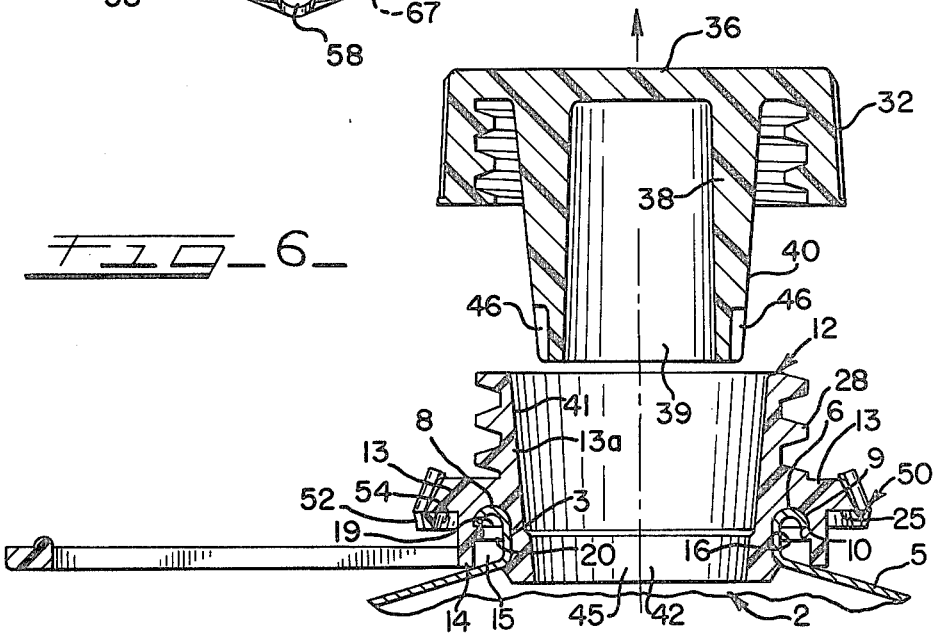

PILFERPROOF CONTAINER

DESCRIPTION OF THE INVENTION

BACKGROUND ART

Tamper-proof closures of the type under consideration are usually applied to glass bottle finishes which are relatively rigid structures as exemplified in U.S. Pat. No. 3,329,295. In such structure the inherent nature of the glass is inflexible and the locking shoulder thereon will not deflect and thus will not permit the tamper-indicating band on the cap to slip off.

Furthermore conventional arrangements of severable tamper-proof band applications include a plurality of weak bridges which connect the band to the cap which must be simultaneously broken to release the band from the cap. Excessive resistance to unthreading of the cap develops and, frequently after great effort, the band slips over the locking shoulder thus frustrating the tamper indicating feature.

TECHNICAL FIELD

This invention is directed to a neck and cap assembly, the neck being preferably made of flexible material. The cap has a tamper-indicating ring attached to it by break-away strips. The ring is provided with posts which serve three functions:

1. to transmit press-on loads from the capper head of a machine designed to thread the cap onto the threaded neck and thus to wedge the ring over a shoulder formed on the neck;
2. to use the posts to stretch the band into a series of segments underlapping the shoulder; and
3. to use the posts in the preferred embodiment of the invention as means to catch onto teeth provided on the shoulder to prevent rotation of the pilfer-indicating ring during initial unthreading of the cap and thus as a means of easily breaking away the ring off from the cap.

This invention relates to cap and neck assemblies wherein both the cap and band are formed from stretchable or distortable plastic material.

DISCLOSURE OF INVENTION

This invention relates to an arrangement of a deflectible plastic neck extension inserted onto a neck of a container, the neck on the container telescoping into the extension and stabilizing the extension in certain critical areas, and particularly in the region of a shoulder formed on the neck extension which cooperates with a captive frangible portion of the cap such that upon unauthorized opening of the container, the frangible portion of the cap breaks off and reveals that tampering has occurred. The telescoped portions are also formed to interlock with each other to prevent axial separation and enhance sealing between the parts in the mating areas.

A general object of the invention is to provide a cap which has a novel tamper-indicating band including load-transmitting elements which function to force the band over a locking shoulder on the neck and further function to stretch the band as a series of straight chordal sectors beneath the locking shoulder, the elements being arranged in one embodiment to catch on ratchet-like teeth and break away from the cap when the cap is unthreaded the first time after initial closure of the cap onto the neck of the container.

These and other objects and advantages inherent in and encompassed by the invention will become more apparent from the specifications and the drawings.

BRIEF DESCRIPTION OF THE DRAWINGS

FIG. 4 is a section similar to FIGS. 2 and 3 showing the cap in initial fully applied position;

FIG. 5 is a cross-sectional view taken substantially on line 5—5 of FIG. 4;

FIG. 6 shows the assembly in cross-section similar to FIG. 2 but with the cap unthreaded from the threaded on position of FIG. 4 and illustrating the tamper-indicating band broken away from the cap;

FIG. 7 being a cross-sectional view similar to FIG. 5;

FIG. 8 being a view similar to FIG. 7 but showing the cap slightly unthreaded; and FIG. 9 being a perspective view with parts shown as in FIG. 8.

BEST MODE OF CARRYING OUT THE INVENTION

Figure 1:
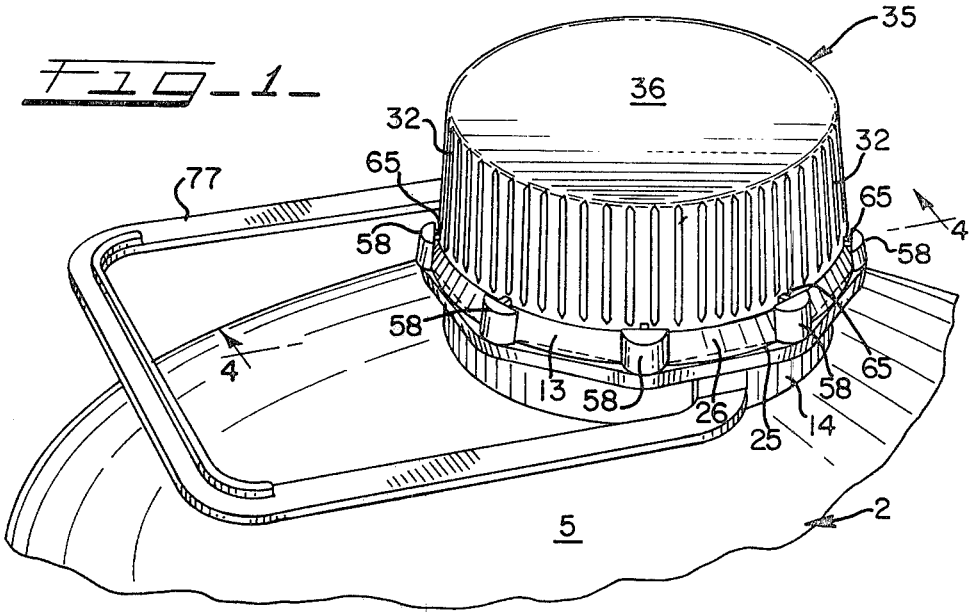
FIG. 1 is a perspective view of the closure and can assembly.
Figure 2:
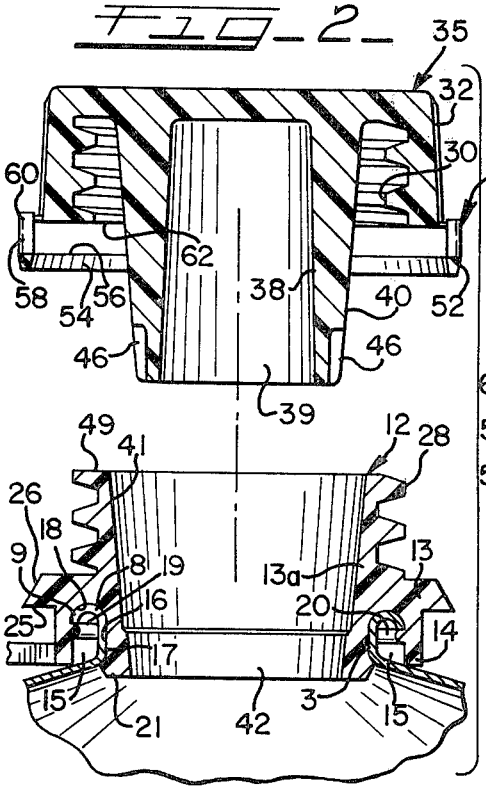
FIG. 2 is an exploded view in axial section of the assembly.

Describing the invention in detail, there is fragmentarily shown in the drawings, a container in the form of a bottle or flask preferably made of metal or plastic having an integral neck 3 defining a pour opening. The neck 3 is a generally cylindrical metal tube integral with the wall 5 of the container and terminates in an outturned annular bead 6 which is of generally inverted U-shape in cross section including an upwardly convexed upper portion 8 and a downturned peripheral flange 9 which terminates in a flat bottom edge 10 which extends preferably normal to the axis X-X FIG. 3 of the container.

The neck is provided with a fitment or extension 12 made of any desired flexible plastic material such as polyethylene or polypropylene or the like.

The fitment or neck extension 12 has a generally cylindrical body portion 13*a* which intermediate its ends, has a radially outwardly extending annular locking shoulder or abutment 13 with a depending sleeve 14 which is radially outwardly spaced from an opposing section of the body portion 13*a* and defines a neck-accommodation slot 15 into which the neck 3 extends.

The exterior surface 16 of neck portion 12 seats tightly against the interior bore surface 17 of the neck 3 and the upper portion 8 of the neck bead 6 fits into a complementary groove 18 and the downturned flange 9 snaps over and seats with its surface 10 upon the top edge 19 of an annular shoulder 20 formed on the interior of the ring 14. The bead portion 6 and the arrangement of the sleeve and the position of the flange 9 all contribute to rigidify the shoulder 13 and adjacent portion of the neck extension 12.

The fitment has another locking flange portion 21 which is formed as an annulus on bottom end of the fitment and underlaps the top wall 5 of the container.

The annular locking shoulder 13 extends outwardly of sleeve 14 and has a bottom locking surface 25 substantially normal to the X-X axis (FIG. 3) of the neck assembly 3, 12 and also has a peripheral frusto-conical guide surface 26 which tapers upwardly.

Above the shoulder 13 the extension 12 has external threads 28 which cooperate with complementary threads 30 on the interior of a skirt portion 32 of a plastic cap 35 which may be made of the same material as the fitment 12.

The skirt is integrally formed at its upper end with a top wall 36 which has a central depending hollow sealing plug 38 on its bottom side spaced radially inwardly from the skirt.

The plug 38 is formed with a frusto-conical outer surface 40 which fits loosely into a complementally shaped frusto-conical surface 41 on the interior of the fitment 12.

Figure 3:
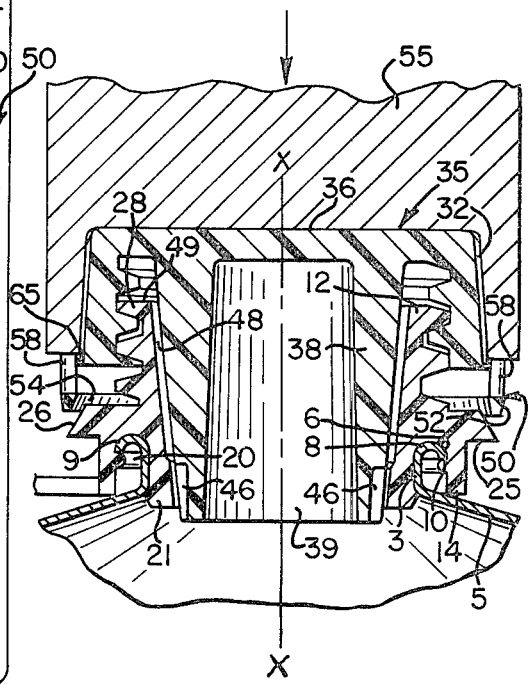
FIG. 3 is a view similar to FIG. 2 except that the parts are shown in position preparatory to initial application by the applicator bead.

As will be observed in FIGS. 3 and 4, the lower end portion 39 of the plug 38 fits tightly into and has a sealing engagement with the reduced diameter lower end portion 42 of the fitment so that upon the cap being threaded tightly onto the neck extension 12, the lower end portion 39 of the plug wedges into and expands the portion 42 causing the external annulus 21 thereon to spread outwardly under the top wall 5 and the surface 40 and surface 45 of the lower portion of extension 12 to tightly sealingly engage each other.

It will be noted that the lowermost end portion of the plug is provided with axially extending slots 46, 46 which in the closed position of the cap are located below the surface 45 and when the cap is partly unthreaded these slots assume the position of FIG. 3 whereat any pressurized gasses in the container bleed off into the space 48 between surfaces 40, 41 and between the bottom side of wall 36 and upper end 49 (FIG. 3) of the fitment and through the spacing between the threaded into the atmosphere.

An important feature of this invention is in providing a pilferproof indicia structure 50 which comprises a stretchable band 52 of larger diameter than the skirt and having an internal frusto-conical guide surface 54 which is adapted, as best seen in FIG. 3, to telescope over the complemental surface 26 attendant to the cap being mounted in a capper bead 55 of any well known construction.

The band 52 is formed integral at its top edge 56 with a plurality of equally spaced relatively thick driving posts or columns 58 which project at their upper end portions 60 slightly above the lower edge 62 of the skirt of the cap.

Each post is connected on its interior below its upper end portion 60 to the exterior of the lower portion of the skirt by a thin, narrow fracturable bridge or strap 65.

As best seen in FIG. 3 as the cap is being threaded on by the head 55 which bears at its lower edge against the upper edges of the columns 58 the band 52 is stretched over the locking shoulder 13, the load being transmitted from the capper to the band through the posts, until the band clears the shoulder 13 whereupon the expanded band snaps or contracts under the shoulder 13 just prior to the cap being fully tightened to seal the container. It will be noted that in the closed position of the cap as seen in FIGS. 1, 4 and 5 the band 52 is stretched in sections 67, 67 as chords subtending sectors of the annular shoulder 13 and these chordal portions 67 are trapped beneath the respective sectors of shoulder 13 so that upon unscrewing of the cap as seen in FIG. 6, the frangible straps or bridges 65 are prevented from leaving the shoulder and the band is broken away at bridges 65 from the cap thus indicating the tampering with the package since the band will normally visibly separate from the cap.

EMBODIMENT OF FIGS. 7–9

Figure 7:
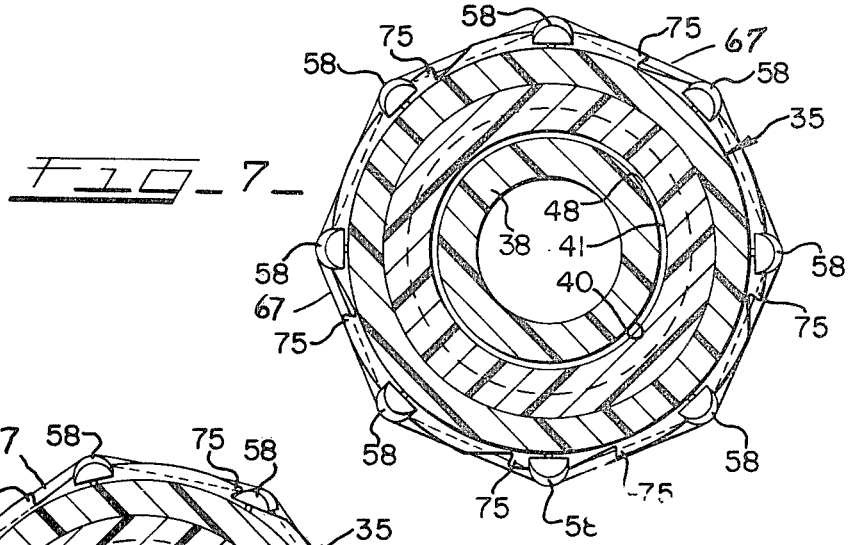
FIGS. 7–9 illustrate a modification of the invention.
Figure 8:
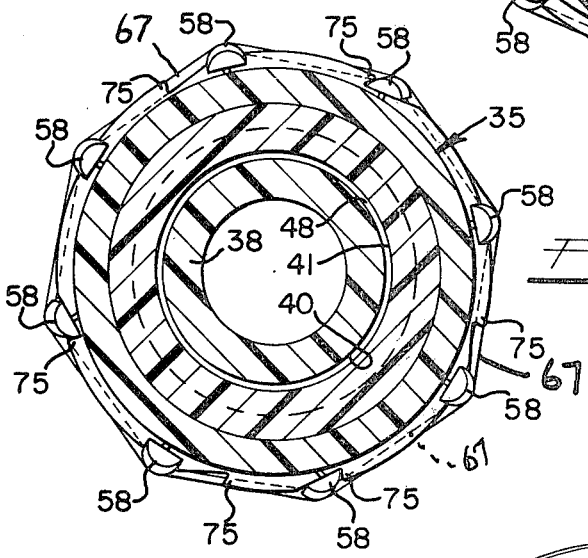
Figure 9:
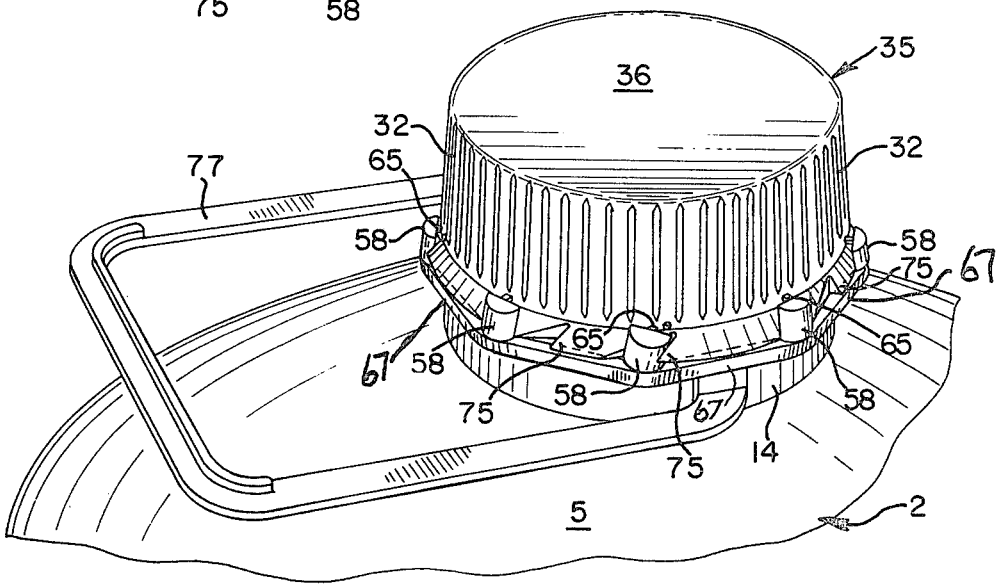

FIGS. 7–9 show a modification of the invention wherein like parts are identified with the same numerals as the previous embodiment. In this modification the shoulder 13 is formed with a series of peripheral ratchet teeth 75 which upon the cap being unscrewed catch on the posts and tear the ring 52 off. The teeth are so spaced that at any instant of unthreading of the cap only one post catches one of the teeth 75.

In order to facilitate carrying of the bottle or container the neck position is provided with a handle 77.

It will be understood that various modifications of the invention will become apparent to those skilled in the art in view of the disclosure of a preferred embodiment of the invention, which modifications are intended to be covered in the appended claims.

What is claimed is:

1. In a closure, the combination of a container having a threaded neck with an outwardly projecting locking means thereon, a cap having a threaded skirt adapted to be threaded onto the neck, a continuous stretchable plastic anti-pilfer band having a tear-apart connection with the skirt, means on the band and said locking means for stretching said band over said locking means and disposing the same in locked position therewith attendant to initial threading of the cap on the neck, and means on said locking means and said band for holding said band in locked association with said locking means and preventing said band from releasing from said locking means, said connection being formed and arranged to tear apart upon said cap being initially unscrewed to open the container, and means for holding said band at circumferentially spaced points from entering under said shoulder and stretching said band as chordal segments beneath said shoulder.

2. In a closure, the combination of a container having a threaded neck with an outwardly projecting locking means thereon, a cap having a threaded skirt adapted to be threaded onto the neck, a stretchable plastic anti-pilfer band having a tear-apart connection with skirt, means on the band and said locking means for stretching said band over said locking means and disposing the same in locked position therewith attendant to initial threading of the cap on the neck, and means on said locking means and said band for holding said band in locked association with said locking means and preventing said band from releasing from said locking means, said connection being formed and arranged to tear apart upon said cap being initially unscrewed to open the container, and wherein said means on said band comprises load-transmitting members disposed outwardly of the skirt for facilitating assembly of said band with said locking means.

3. The invention according to claim 2 wherein said locking means comprises a shoulder extending radially outwardly from said neck and said band and shoulder having cooperative caming surfaces facilitating stretching of the band over said shoulder.

4. In a closure, the combination of a container having a threaded neck with an outwardly projecting locking means thereon, a cap having a threaded skirt adapted to be threaded onto the neck, a stretchable plastic anti-pilfer band having a tear-apart connection with said skirt, means on the band and said locking means for stretching said band over said locking means and disposing the same in locked position therewith attendant to initial threading of the cap on the neck, and means on said locking means and said band for holding said band in locked association with said locking means and preventing said band from releasing from said locking means, said connection being formed and arranged to tear apart upon said cap being initially unscrewed to open the container, said locking means comprising a shoulder extending radially outwardly from said neck and said band and shoulder having cooperative caming surfaces facilitating stretching of the band over said shoulder, and said band comprises load transmitting push-on posts for application of the band onto and over said shoulder by associated mechanisms and said band in the locked position with said shoulder being distorted into chordal segments between respective posts bearing against the periphery of said shoulder.

5. In a closure, the combination of a container having a threaded neck with an outwardly projecting locking means thereon, a cap having a threaded skirt adapted to be threaded onto the neck, a stretchable plastic anti-pilfer band having a tear-apart connection with said skirt, means on the band and said locking means for stretching said band over said locking means and disposing the same in locked position therewith attendant to initial threading of the cap on the neck, and means on said locking means and said band for holding said band in locked association with said locking means and preventing said band from releasing from said locking means, said connection being formed and arranged to tear apart upon said cap being initially unscrewed to open the container, said locking means comprising a shoulder extending radially outwardly from said neck and said band and shoulder having cooperative caming surfaces facilitating stretching of the band over said shoulder, and said locking means comprising teeth means formed and arranged to cam said band over the teeth means in the screw-on direction of movement of the cap during initial application of the cap, said teeth means having means for engaging portions of said band to prevent the band from being cammed off said locking means upon the cap being initially unscrewed and effecting tearing apart of said connection, and load-transmitting means forming part of said tear-apart connection disposed outwardly of said skirt for transmitting force to said band from associated mechanism and thereby forcing the band over said locking means during initial application of the cap onto said neck.

6. In a closure, the combination of a container having a threaded neck with an outwardly projecting locking means thereon, a cap having a threaded skirt adapted to be threaded onto the neck, a stretchable plastic anti-pilfer band having a tear-apart connection with skirt, means on the band and said locking means for stretching said band over said locking means and disposing the same in locked position therewith attendant to initial threading of the cap on the neck, and means on said locking means and said band for holding said band in locked association with said locking means and preventing said band from releasing from said locking means, said connection being formed and arranged to tear apart upon said cap being initially unscrewed to open the container, wherein said locking means comprises a shoulder extending radially outwardly from said neck and said band and shoulder having cooperative caming surfaces facilitating stretching of the band over said shoulder, and said band having an upper edge and said locking means comprising a circumferential edge and a lower edge, said lower edge engaging the upper edge of the band to prevent removal of the band from under the shoulder and said lower and upper edges disposed substantially normal to the longitudinal axis of the closure, and means on the band positioned to engage with the circumferential edge of said shoulder for stretching the band beneath said shoulder into chordal segments.

7. A closure for a container having a threaded neck portion with an external annular radially extending shoulder, a cap formed of plastic material including a skirt having a lower edge and having threads for threaded engagement with the threads on said neck portion, said cap comprising below said lower edge an anti-pilfer band formed of plastic material stretchable over the shoulder attachment to initial application of the cap to the neck portion, said band contractable under the shoulder upon said initial application of the cap, breakable means connecting the band with the cap, and load carrying means on the band disposed radially outwardly of the skirt in position for directing loads from associated mechanism against the band for effecting said initial application.

8. The invention according to claim 7 and cooperatively arranged cam means on the band and on said shoulder for stretching said band over the shoulder.

9. A closure for a container having a threaded neck portion with an external annular radially extending shoulder, a cap formed of plastic material including a skirt having threads for threaded engagement with the threads on said neck portion, said cap comprising an anti-pilfer band formed of plastic material stretchable over the shoulder attendant to initial application of the cap to the neck portion and contractable thereunder, breakable means connecting the band with the cap, and load carrying means on the band for directing loads from associated mechanism against the band for effecting said initial application, and said load-carrying means comprising posts elongated axially of the cap and extending upwardly from the band and outwardly of the skirt in radially overlapping relation thereto.

10. The invention according to claim 9 and said breakable means extending between the posts and the skirt.

11. The invention according to claim 8 and said cam means comprising interengageable frusto-conical faces on said band and said shoulder.

12. The invention according to claim 9 and said shoulder comprising ratchet means engageable with said posts accommodating initial application of the cap and closing rotation thereof and preventing opening rotation of the cap and upon forced opening rotation of the cap breaking said breakable connecting means.

13. A pilferproof cap comprising a skirt with threads therein, a top, an elastic band at the bottom edge of the skirt, circumferentially spaced load-transmitting columns connected to the band, and frangible bridges connecting the columns with the skirt.

14. The invention according to claim 13 and said band having assembly-facilitating wedge means for guiding the band onto associated locking means.

15. A closure for a container having a top and a pouring neck extending therefrom, a neck extension formed of deformable plastic material comprising a portion fitted into the neck in complimentary engagement therewith, a shoulder extending radially from intermediate the ends of the extension and beyond the neck, a sleeve depending from the shoulder and telescoped over the neck and having an internal annular bead, a hook-shaped portion about the neck hooked over said bead, said extension having a lower end portion including an annulus flared under said top wall, a cap having a top, a skirt depending from the top, a plug centered within the skirt depending from the top and having a wedge-like periphery, said extension having a frusto-conical base with a reduced diameter portion at its lower end portion, said plug in the closed position of the closure extending into said reduced diameter portion and wedging the same apart and urging said annulus under said top wall and the lower portion of the neck extension tightly against said neck, said bead positioned at a location adjacent to said shoulder and with said hook shaped portion resisting upward deflection of said shoulder for preventing removal of an associated tamper-indicating means.

16. A closure for container having a threaded neck portion with an external annular radially extending shoulder, a cap formed of plastic material including a skirt having threads for threaded engagement with the threads on said neck portion, said cap comprising an anti-pilfer band formed of plastic material stretchable over the shoulder attendant to initial application of the cap to the neck portion and contractable thereunder, breakable means connecting the band with the cap, and load carrying means on the band for directing loads from associated mechanism against the band for effecting said initial application, and ratchet means on said shoulder comprising unevenly spaced teeth about the periphery of said shoulder and said breakable means being spaced apart circumferentially of the band at locations positioning said breakable means to randomly catch on respective teeth whereby upon unthreading of the cap only certain of said breakable means at any instant of rotation resisting rotation of the cap and thereby requiring minimum force to break the band away from the cap.

* * * * *